US005545248A

United States Patent [19]

Tokumoto et al.

[11] Patent Number: 5,545,248

[45] Date of Patent: Aug. 13, 1996

[54] TITANIUM-BASE HARD SINTERED ALLOY

[75] Inventors: Kei Tokumoto; Tetsunori Kitada; Hironobu Shinoaki; Shigeya Sakaguchi, all of Fukuoka, Japan

[73] Assignee: Nippon Tungsten Co., Ltd., Fukuoka-ken, Japan

[21] Appl. No.: 388,325

[22] Filed: Feb. 14, 1995

Related U.S. Application Data

[63] Continuation-in-part of Ser. No. 67,370, May 26, 1993, abandoned.

[30] Foreign Application Priority Data

Jun. 8, 1992 [JP] Japan ..... 4-147626

[51] Int. Cl.[6] ..... C22C 29/04

[52] U.S. Cl. ..... 75/238; 75/239; 75/245; 501/93

[58] Field of Search ..... 75/238, 239, 245; 501/93

[56] References Cited

U.S. PATENT DOCUMENTS

| | | | |
|---|---|---|---|
| 4,118,254 | 10/1978 | Knotek et al. | 148/32 |
| 4,120,719 | 10/1978 | Nomura et al. | 75/238 |
| 4,422,874 | 12/1983 | Nishimura et al. | 75/238 |
| 4,563,215 | 1/1986 | Yamomoto et al. | 75/238 |
| 4,948,425 | 8/1990 | Watanabe et al. | 75/238 |
| 5,041,399 | 8/1991 | Fukaya et al. | 501/87 |
| 5,145,506 | 9/1992 | Goldstein et al. | 75/240 |
| 5,248,352 | 9/1993 | Nakahara et al. | 148/421 |

FOREIGN PATENT DOCUMENTS

| | | |
|---|---|---|
| 106416 | 6/1974 | Germany . |
| 5119403 | 12/1973 | Japan . |
| 5419846 | 10/1975 | Japan . |
| 53-125208 | 1/1978 | Japan . |
| 55-14860 | 4/1980 | Japan . |
| 5045708 | 8/1983 | Japan . |
| 60-224732 | 11/1985 | Japan . |
| 1119639 | 5/1989 | Japan . |
| 2129330 | 5/1990 | Japan . |
| 3285034 | 12/1991 | Japan . |
| 483837 | 3/1992 | Japan . |

OTHER PUBLICATIONS

Journal of The Japan Society of Powder and Powder Mettallurgy vol. 22, No. 3, May 1975.

Boehlke, W. et al, Chemical Abstract, 82, 76462r, 1975.

Chemical Abstract, 94, 19401, 1981.

*Primary Examiner*—Ngoclan Mai

*Attorney, Agent, or Firm*—Jordan and Hamburg

[57] ABSTRACT

A titanium-base sintered alloy which comprises a TiC and/or TiN or Ti(C,N) solid solution accounting for 5 to 70 vol %, with the remainder being composed of two components. The first component is at least one species selected from the group consisting of Groups Va and VIa metallic elements, except Cr, or at least one species selected from the group consisting of carbides, nitrides, and carbonitrides of Groups Va and VIa metallic elements, except Cr. The second component is titanium. The first component accounts for 1 to 30 vol % and the second component accounts for 70 to 99 vol % of the total amount of the first and second components. The alloy produces a preferred result when the content of TiC or TiN is 35 to 70 vol % and the first component accounts for 1 to 15 vol % of the remainder. It is desirable that the TiC, TiN, and the first component of the remainder be in the form of a solid solution. This alloy exhibits improved wear resistance, strength, and specific strength without any loss in corrosion resistance.

3 Claims, 1 Drawing Sheet

TITANIUM-BASE HARD SINTERED ALLOY

REFERENCE TO RELATED APPLICATION

This is a continuation-in-part of application Ser. No. 08/067,370, filed May 26, 1993 now abandoned.

BACKGROUND OF THE INVENTION

The present invention relates to a titanium-base hard sintered alloy suitably used as a corrosion- and wear-resistant material for casting molds, pump parts, bearings, mechanical seals, valves, pipes, stirrers, mixers, and blades.

Conventional corrosion- and wear-resistant materials for the above uses are exemplified by the cemented carbides disclosed in Japanese Unexamined Patent Publications Nos. 50-45708 and 1-119639; Stellite, high-chromium cast iron, and SUS440 stainless steel disclosed in Japanese Unexamined Patent Publications Nos. 53-125208 and 60-224732; and Ti—Nb and Ti-6%A1-4%V alloys disclosed in Japanese Unexamined Patent Publication No. 4-83837.

Wear resistance and corrosion resistance are incompatible with each other. Cemented carbides, Stellite, high-chromium cast iron, and hard stainless steel are superior in wear resistance, but not necessarily good in corrosion resistance and, hence, they cannot be used under severe conditions.

Particularly, titanium alloys containing 15 to 30 wt % molybdenum are renowned for having much higher corrosion resistance than pure titanium. However, though titanium alloys are superior in corrosion resistance, they are insufficient in wear resistance.

A titanium alloy with improved wear resistance exists which contains a carbide dispersed therein. It is produced by melting as disclosed in Japanese Unexamined Patent Publication Nos. 2-129330 and 3-285034. Unfortunately, it suffers from disadvantages due to melting. Specifically, its carbide is in the form of coarse grains, which leads to insufficient hardness and wear resistance. In addition, it requires difficult machining to be made into parts having a complex shape after casting.

In order to address the above-mentioned melting problem associated with the titanium alloy, the prevent inventors developed one which is made by powder metallurgy, as disclosed in "Journal of the Japan Society of Powder and Powder Metallurgy", vol 22 No 3. Their development led to a sintered alloy of Ti-30Mo (15.9 vol % Mo) and a sintered alloy of Ti—Mo—TiC having improved wear resistance which is obtained by incorporating the former with TiC in an amount of 10 to 35 wt % (10.1 to 37.2 vol %), as disclosed in Japanese Patent Publication Nos. 51-19403 and 54-19846.

Meanwhile, chemical and machine industries now need titanium-base sintered alloys which, under more severe conditions than before, exhibit good wear resistance as well as high strength without any loss in the corrosion resistance inherent in titanium. This need is not met by the above-mentioned Ti—Mo—TiC sintered alloy because of its insufficient wear resistance and strength. Additionally, the Ti—Mo—TiC sintered alloy does not have sufficient corrosion resistance even though the amount of TiC therein is increased.

SUMMARY OF THE INVENTION

It is an object of the present invention to provide a titanium-base sintered alloy which, owing to its increased hardness, exhibits higher wear resistance and/or strength and specific strength than a conventional alloy without any loss in corrosion resistance.

The present invention is embodied in a titanium-base sintered alloy which comprises a TiC and/or TiN or Ti(C, N) solid solution accounting for 5 to 70 vol %, with the remainder being composed of two components. The first component being at least one species selected from the group consisting of Groups Va and VIa metallic elements except Cr, or at least one species selected from the group consisting of carbides, nitrides, and carbonitrides of Groups Va and VIa metallic elements, except Cr. The second component being titanium. The first component accounting for 1 to 30 vol % and the second component accounting for 70 to 99 vol % of the total amount of the first and second components combined.

Preferably, the content of TiC or TiN is 37.2 to 70 vol % and the first component accounts for 1 to 15 vol % of the remainder in the titanium-base sintered alloy.

According to a preferred embodiment, the major constituent, which is TiC and/or TiN or Ti(C, N) solid solution, and the first component of the remainder, which is at least one species selected from the group consisting of Groups Va and VIa metallic elements, except Cr, and their mutual solid solutions, and carbides, nitrides, and carbonitrides of Groups Va and VIa metallic elements, except Cr, and their mutual solid solutions, are in the form of a solid solution.

DETAILED DESCRIPTION OF THE INVENTION

Figure 1:
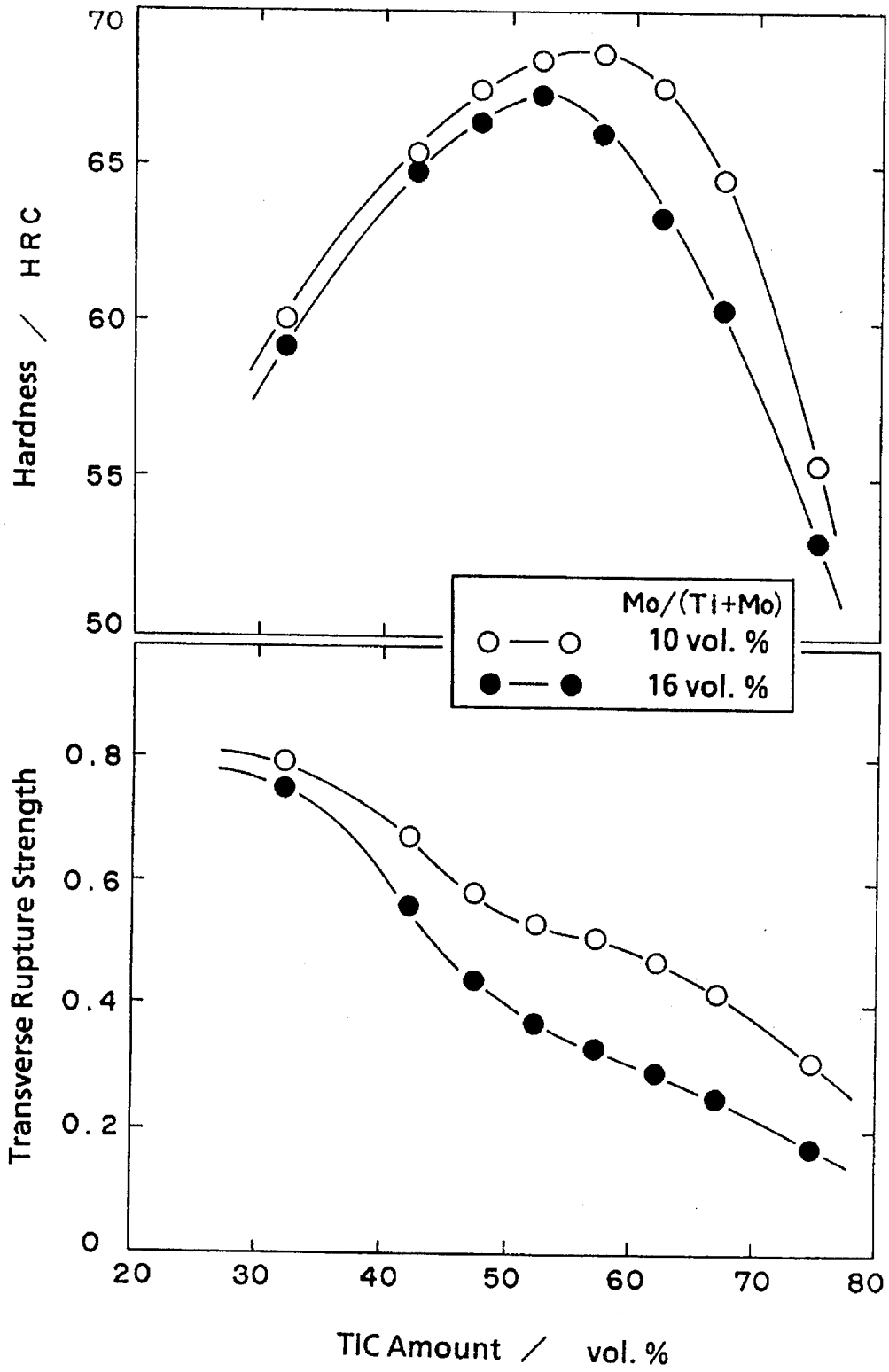
FIG. 1 is a graph showing how the alloy of the present invention varies in transverse rupture strength depending on the amount of TiC, with the Mo/(Ti+Mo) ratio remaining constant.

The titanium-base hard sintered alloy of the present invention provides high wear resistance and hardness owing to its increased content of TiC or TiN, and additionally provides high strength while maintaining good corrosion resistance owing to its composition M/(Ti+M) in a specific range where M denotes a Group Va or VIa metallic element or a solid solution thereof.

The following description is given on the assumption that the titanium-base hard sintered alloy is composed of Ti, Mo, and TiC. This sintered alloy has two phases of Ti and TiC, with Mo more resolved in the Ti phase than in the TiC phase. The amount of TiC should be properly controlled because the Ti in the Ti phase dissolves in the TiC phase, increasing the content of Mo in the Ti phase beyond what is intended. The increased Mo content lowers the transverse rupture strength, hardness, and corrosion resistance. To avoid this situation, it is necessary to decrease the amount of Mo if a large amount of TiC is to be incorporated into the alloy.

According to the present invention, the metallic element, except Cr, which is added may be in the form of a carbide or nitride. In this case, the titanium-base sintered alloy contains its metallic element both in the form of a solid solution in the Ti phase in the carbide or nitride. The solid solution forms after the carbide or nitride has decomposed. As this decomposition takes a long time, the concentration of the solute (metallic element) in the Ti phase remains low. This favors a properly controlled composition with improved physical properties.

Mo, as the solute element in the Ti phase, may be partly or entirely replace by Nb, Ta, or W belonging to Group Va or VIa. Because of their smaller diffusion coefficient compared to that of Mo, the concentration of Nb, Ta, or W in the Ti phase is lower than that of Mo. This prevents grain growth in the TiC or TiN phase and improves the hardness and transverse rupture strength. The metallic elements used in Groups Va and VIa have diffusion coefficients in the Ti phase at 1673K as shown below.

Mo . . . $1.158\times10^{-12}$ ($m^2/s$)

Nb . . . $0.779\times10^{-12}$

Ta . . . $0.272\times10^{-12}$

W . . . $0.648\times10^{-12}$

V . . . $3.214\times10^{-12}$

Incidentally, despite having greater diffusion coefficients than Mo, V provides the sintered alloy with a high degree of hardness and strength if sintering is carried out under adequate conditions. Moreover, their low specific gravity is favorable to high specific strength.

For example, when the composition of the present invention is (A) at least one of TiC, TiN and Ti(C,N) present in 5–70 vol. % and (B) (a) Ti present in 7–99 vol. % and (b) at least one metal of Group Va or VIa, except Cr, present in 1–30 vol. %, the hard phase is (A) and (a) solid-soluted with (b). Additionally, the metallic phase consists only of Ti.

When the composition of the present invention is (A) at least one of TiC, TiN and Ti(C,N) present in 5–70 vol. % and (B)(a) Ti present in 7–99 vol. % and (b) at least one compound selected from the group consisting of carbides, nitrides and carbonitrides of Group Va or VIa, except Cr, present in 1–30 vol. %, the hard phase is (A) solid-soluted with a part of (b), and (a) solid-soluted with retained (b).

The invention will be understood more readily by reference to the following examples. However, these examples are intended only to illustrate the invention and should not be construed to limit the scope of the invention.

EXAMPLES

Commercial Ti powder, Mo powder and TiC powder were mixed using an automated mortar for 1 hour according to the formulation shown in Table 1. The resulting mixture was press-formed at 2000 kg/cm$^2$. The compact was sintered at 1300° to 1500° C. for 2 hours in a vacuum atmosphere. The resulting sintered body was tested for hardness. ($H_RC$), transverse rupture strength (GPa), and corrosion resistance. The results are shown in Table 2. Corrosion resistance is expressed in terms of the rate of the corrosion that occurs when the sample is immersed in a dry cell mix for 7 days.

o=0.05 mm/year or less.

Δ=0.1 mm/year or less.

X=more than 0.1 mm/year.

TABLE I

| Sample No. | Composition (vol %) Ti | Ta | Mo | W | TiC | TiN | Ti(C,N) | Sintering temp. (°C.) |
|---|---|---|---|---|---|---|---|---|
| Example | | | | | | | | |
| 1 | 44.3 | 8.4 | | | 47.3 | | | 1400 |
| 2 | 35.8 | 6.8 | | | 57.4 | | | 1400 |
| 3 | 27.6 | 5.2 | | | 67.2 | | | 1400 |
| 4 | 64.8 | | 3.1 | | 32.1 | | | 1400 |
| 5 | 61.1 | | 6.8 | | 32.1 | | | 1400 |

TABLE I-continued

| Sample No. | Composition (vol %) Ti | Ta | Mo | W | TiC | TiN | Ti(C,N) | Sintering temp. (°C.) |
|---|---|---|---|---|---|---|---|---|
| 6 | 55.0 | | 2.7 | | 42.3 | | | 1400 |
| 7 | 52.0 | | 5.7 | | 42.3 | | | 1400 |
| 8 | 50.3 | | 2.4 | | 47.3 | | | 1400 |
| 9 | 47.5 | | 5.2 | | 47.3 | | | 1400 |
| 10 | 47.5 | | 5.2 | | | 47.3 | | 1400 |
| 11 | 47.5 | | 5.2 | | | | 47.3 | 1400 |
| 12 | 45.4 | | 2.2 | | 52.4 | | | 1400 |
| 13 | 42.9 | | 4.7 | | 52.4 | | | 1400 |
| 14 | 40.6 | | 2.0 | | 57.4 | | | 1400 |
| 15 | 38.4 | | 4.2 | | 57.4 | | | 1400 |
| 16 | 36.0 | | 1.7 | | 62.3 | | | 1400 |
| 17 | 33.9 | | 3.8 | | 62.3 | | | 1400 |
| 18 | 31.3 | | 1.5 | | 67.2 | | | 1400 |
| 19 | 29.5 | | 3.3 | | 67.2 | | | 1400 |
| 20 | 44.3 | | | 8.4 | 47.3 | | | 1400 |
| 21 | 35.8 | | | 6.8 | 57.4 | | | 1400 |
| 22 | 27.6 | | | 5.2 | 67.2 | | | 1400 |
| 23 | 57.1 | | 10.8 | | 32.1 | | | 1400 |
| 24 | 48.5 | | 9.2 | | 42.3 | | | 1400 |
| 25 | 44.3 | | 8.4 | | 47.3 | | | 1400 |
| 26 | 40.0 | | 7.6 | | 52.4 | | | 1400 |
| 27 | 35.8 | | 6.8 | | 57.4 | | | 1400 |
| 28 | 31.7 | | 6.0 | | 62.3 | | | 1400 |
| 29 | 27.6 | | 5.2 | | 67.2 | | | 1400 |
| Comp. Example | | | | | | | | |
| 1 | 37.7 | | | | 62.3 | | | 1400 |
| 2 | 21.0 | | 4.0 | | 5.0 | | | 1400 |
| 3 | TI(JIS No. 2) | | | | | | | |
| 4 | Ti—6Al—4V | | | | | | | |
| 5 | Ti—15V—3Cr—3Al—3Sn—1.3C | | | | | | | |
| 6 | Stellite #6 | | | | | | | |
| 7 | SUS 304 | | | | | | | |
| 8 | WC—1.0Cr—8.0Ni | | | | | | | |

Note: Ti(C,N) = Ti($C_{0.5}$, $N_{0.5}$)

TABLE 2

| Sample No. | Hardness ($H_RC$) | Transverse rupture strength (GPa) | Tensile strength (GPa) | Corrosion resistance | Overall rating |
|---|---|---|---|---|---|
| Example | | | | | |
| 1 | 64.3 | 0.78 | | o | ϕ |
| 2 | 69.3 | 0.58 | | o | ϕ |
| 3 | 58.3 | 0.36 | | o | ϕ |
| 4 | 54.0 | 0.78 | | o | ϕ |
| 5 | 60.1 | 0.79 | | o | ϕ |
| 6 | 59.0 | 0.56 | | o | ϕ |
| 7 | 65.4 | 0.67 | | o | ϕ |
| 8 | 62.2 | 0.51 | | o | ϕ |
| 9 | 67.5 | 0.58 | | o | ϕ |
| 10 | 67.8 | 0.62 | | o | ϕ |
| 11 | 62.6 | 0.49 | | o | ϕ |
| 12 | 64.4 | 0.47 | | o | ϕ |
| 13 | 68.5 | 0.53 | | o | ϕ |
| 14 | 65.0 | 0.45 | | o | ϕ |
| 15 | 68.6 | 0.51 | | o | ϕ |
| 16 | 65.9 | 0.44 | | o | ϕ |
| 17 | 67.5 | 0.47 | | o | ϕ |
| 18 | 66.2 | 0.40 | | o | ϕ |
| 19 | 64.5 | 0.42 | | o | ϕ |
| 20 | 64.1 | 0.68 | | o | ϕ |
| 21 | 68.9 | 0.56 | | o | ϕ |
| 22 | 58.0 | 0.35 | | o | ϕ |
| 23 | 59.2 | 0.75 | | o | o |
| 24 | 64.8 | 0.56 | | o | o |
| 25 | 66.4 | 0.44 | | o | o |

TABLE 2-continued

| Sample No. | Hardness ($H_RC$) | Transverse rupture strength (GPa) | Tensile strength (GPa) | Corrosion resistance | Overall rating |
|---|---|---|---|---|---|
| 26 | 67.3 | 0.37 | | o | o |
| 27 | 66.0 | 0.33 | | o | o |
| 28 | 63.3 | 0.29 | | o | o |
| 29 | 60.4 | 0.25 | | o | o |
| | | | | o | o |
| Comp. Example | | | | | |
| 1 | 57.2 | 0.17 | | Δ | Δ |
| 2 | 53.0 | 0.17 | | o | Δ |
| 3 | 24.0 | | 0.40 | o | x |
| 4 | 35.0 | | 0.93 | o | x |
| 5 | 40.0 | | | o | Δ |
| 6 | 40.0 | | 0.73 | Δ | x |
| 7 | 10.0 | | 0.52< | x | x |
| 8 | 90.0 ($H_RA$) | 2.20 | | x | x |

The following is noted from Tables 1 and 2. The alloys (Sample Nos. 1 to 29) pertaining to the present invention are superior in strength and/or hardness and corrosion resistance to the alloy (Sample No. 1 for comparison) containing no Mo. They are superior in strength to the alloy (Sample No. 2 for comparison) containing a large amount of TiC. They are superior in wear resistance to the Ti-base alloys (Sample Nos. 3 to 5 for comparison). They are superior in hardness and corrosion resistance to the Stellite alloy (Sample No. 6 for comparison) and the SUS 304 (Sample No. 7 for comparison). They are far superior in corrosion resistance to the cemented carbide (Sample No. 8 for comparison).

The above amply demonstrates that the alloys of the present invention are superior in general to those in the Comparative Examples.

FIG. 1 shows the relation of hardness ($H_RC$) and transverse rupture strength (GPa) to the amount of TiC (vol %) for the alloys listed in Table 1, with the ratio of Mo/(Ti+Mo) fixed at 16 vol % or 10 vol %. The ratio of 16 vol % is valid for the alloy samples Nos. 23 to 29, and the ratio of 10 vol % is valid for the alloy samples Nos. 5, 7, 9, 13, 15, 17, and 19.

It is noted that the hardness reaches its peak when the amount of TiC is around 50 to 55%, with the maximum value being higher for the Mo/(Ti+Mo) ratio of 10 vol % than for the Mo/(Ti+Mo) ratio of 16 vol %. It is also noted that the transverse rupture strength decreases as the amount of TiC increases, with the values of transverse rupture strength being higher for the Mo/(Ti+Mo) ratio of 10 vol % than for the Mo/(Ti+Mo) ratio of 16 vol %. This suggests that the Mo/(Ti+Mo) ratio should be low for the high TiC content so that the sample will have a high transverse rupture strength. When it comes to corrosion resistance, the samples with the Mo/(Ti+Mo) ratio of 10 vol % are superior to those with the Mo/(Ti+Mo) ratio of 16 vol %. Therefore, the Mo/(Ti+Mo) ratio should preferably be in the range of 1 to 15 vol % so that the alloys are superior in hardness, transverse rupture strength and corrosion resistance.

Alloy sample Nos. 30 to 49 pertaining to the present invention were prepared from Ti and at least one species selected from Groups Va and VIa metallic elements, except Cr, and carbides, nitrides, and carbonitrides of their mutual solid solutions. Table 3 shows their composition and sintering temperature, and Table 4 shows their characteristics properties such as hardness, transverse rupture strength and corrosion resistance and their overall rating.

TABLE 3

| Sample | Composition (vol %) | | | | | | | | | | | Sintering |
|---|---|---|---|---|---|---|---|---|---|---|---|---|
| No. | Ti | Mo | VC | NbC | TaC | TaN | $Mo_2C$ | (Nb,Ta)C | (Ti,Mo)C | WC | TiC | temp. (°C.) |
| 30 | 54.1 | | 11.4 | | | | | | | | 34.5 | 1350 |
| 31 | 43.9 | | 9.2 | | | | | | | | 46.9 | 1350 |
| 32 | 33.9 | | 7.1 | | | | | | | | 59.1 | 1350 |
| 33 | 52.1 | | | 10.3 | | | | | | | 37.6 | 1400 |
| 34 | 42.2 | | | 8.4 | | | | | | | 49.4 | 1400 |
| 35 | 32.5 | | | 6.4 | | | | | | | 61.1 | 1400 |
| 36 | 52.1 | | | | 10.3 | | | | | | 37.5 | 1400 |
| 37 | 42.2 | | | | 8.3 | | | | | | 49.5 | 1400 |
| 38 | 32.5 | | | | 6.4 | | | | | | 61.1 | 1400 |
| 39 | 52.1 | | | | | 10.3 | | | | | 37.6 | 1400 |
| 40 | 48.6 | | | | | | 9.9 | | | | 51.5 | 1500 |
| 41 | 39.4 | | | | | | 8.0 | | | | 52.6 | 1500 |
| 42 | 30.4 | | | | | | 6.1 | | | | 63.5 | 1500 |
| 43 | 42.2 | | | | | | | 8.3 | | | 49.5 | 1400 |
| 44 | 48.6 | | | | | | | | 51.4 | | | 1400 |
| 45 | 36.5 | 5.5 | | 6.5 | | | | | | | 51.5 | 1400 |
| 46 | 39.7 | 5.5 | | | 3.5 | | | | | | 51.3 | 1400 |
| 47 | 53.0 | | | | | | | | | 10.8 | 36.2 | 1400 |
| 48 | 43.0 | | | | | | | | | 8.8 | 48.3 | 1400 |
| 49 | 33.1 | | | | | | | | | 6.7 | 60.1 | 1400 |

Note:
(Nb, Ta)C = $(Nb_{0.5}, Ta_{0.5})C$, (Ti, Mo)C = $(Ti_{0.9}, Mo_{0.1})C$

TABLE 4

| Sample No. | Hardness ($H_RC$) | Strength (GPa) | Corrosion resistance | Overall rating |
|---|---|---|---|---|
| 30 | 58.6 | 0.75 | o | ϕ |
| 31 | 60.4 | 0.50 | o | ϕ |
| 32 | 62.2 | 0.48 | o | ϕ |
| 33 | 61.2 | 0.66 | o | ϕ |
| 34 | 64.6 | 0.46 | o | ϕ |
| 35 | 60.0 | 0.34 | o | ϕ |
| 36 | 63.8 | 0.56 | o | ϕ |
| 37 | 64.7 | 0.80 | o | ϕ |
| 38 | 68.8 | 0.40 | o | ϕ |

TABLE 4-continued

| Sample No. | Hardness ($H_RC$) | Strength (GPa) | Corrosion resistance | Overall rating |
|---|---|---|---|---|
| 39 | 60.6 | 0.53 | o | ϕ |
| 40 | 67.5 | 0.42 | o | ϕ |
| 41 | 67.6 | 0.39 | o | ϕ |
| 42 | 61.2 | 0.34 | o | ϕ |
| 43 | 66.7 | 0.44 | o | ϕ |
| 44 | 68.0 | 0.60 | o | ϕ |
| 45 | 63.2 | 0.48 | o | ϕ |
| 46 | 63.4 | 0.47 | o | ϕ |
| 47 | 63.5 | 0.78 | o | ϕ |
| 48 | 68.1 | 0.68 | o | ϕ |
| 49 | 69.0 | 0.60 | o | ϕ |

It is noted that the samples (Nos. 30 to 49) pertaining to the present invention are superior in hardness, transverse rupture strength, and corrosion resistance when compared to the comparative samples (Nos. 1 to 8). Sample No. 44 has the most superior characteristics.

The samples (Nos. 1 to 3, 30 to 39, 43, 45 and 46) containing V, Nb, and Ta outperformed other samples (Nos. 4 to 29, 40 to 42, 47 to 49) not containing these elements and the comparative samples (Nos. 1 to 8), when immersed in a boiling 50% nitric acid mixture. Moreover, the samples (Nos. 1 to 3, 33 to 39, 43, 45, and 46) containing Nb and Ta were two to five times better than other samples (Nos. 4 to 32, 40 to 42, 44, and 47 to 49) not containing these elements and the comparative samples (Nos. 1 to 8) in oxidation resistance tested by heating in the atmosphere at 800 to 900° C. for 1 hour.

It is concluded from the foregoing that the alloys pertaining to the present invention exhibit improved strength and wear resistance without loss in corrosion resistance, and that the best result is produced when they contain TiC, TiN, or Ti(C,N) in an amount of 35 to 70 vol % and contain Mo such that the ratio of Mo/(Ti+Mo) is within the range of 1 to 15 vol %. According to the present invention, the following effects will be exhibited:

(1) The alloy exhibits improved strength, wear resistance, and specific strength, while retaining the good corrosion resistance inherent in titanium.

(2) The alloy composed of Ti—V—TiC is superior in strength (specific strength) to the conventional Ti—Mo—TiC alloys. It is suitable for corrosion- and wear-resistant parts subjected to severe conditions.

(3) The alloy composed of Ti—(V, Nb, Ta)—TiC is far superior in corrosion resistance (especially to hot nitric acid). It will find use in nuclear fuel treatment plants.

(4) The alloy composed of Ti—(Nb, Ta)—TiC is superior in oxidation resistance. It will find use in power plants where parts are exposed to hot corrosive gases.

(5) The alloy containing TiC, TiN, or Ti(C, N) in an amount of 35 to 70 vol % and containing Mo such that the ratio of Mo/(Ti+Mo) is within the range of 1 to 15 vol % is particularly superior in strength, corrosion resistance and wear resistance. It is more durable than the conventional alloys under severe conditions.

(6) The alloy will find use in corrosion- and wear-resistant parts such as molds (to form dry cell mix), pumps, bearings, mechanical seals, valves, pipes, stirrers, mixers, and blades in the chemical and machine industries. Its outstanding properties extend the life of parts, reduce the frequency of part changes and lessen the amount of required maintenance.

(7) The alloy will meet requirements for operation under severe conditions and contribute to improved operating efficiency.

(8) The alloy will be more reliable in strength than alloys including Cr and its carbide, since alloys including Cr and its carbide tend to produce CO gas which remains in the sintered body and leads to a lower relative density.

Having described the invention, it will be apparent to one of ordinary skill in the art that many changes and modifications can be made thereto without departing from the spirit or scope of the invention as defined in the appended claims.

What we claim is:

1. A corrosion-resisting and wear-resisting titanium-base hard sintered alloy consisting of TiC solid solution accounting for 42 to 67 vol %, with the remainder being composed of two components, the first component being at least one species selected from the group consisting of Groups Va and VIa metallic elements except Cr, the second component being titanium, the first component accounting for 1 to 30 vol % and the second component accounting for 70 to 99 vol % of the total amount of the first and second components.

2. A corrosion-resisting and wear-resisting titanium-base hard sintered alloy consisting of TiC solid solution accounting for 42 to 67 vol %, with the remainder being composed of two components, the first component being at least one species selected from the group consisting of carbides, nitrides, and carbonitrides of Groups Va and VIa metallic elements except Cr, the second component being titanium, the first component accounting for 1 to 30 vol % and the second component accounting for 70 to 99% vol % of the total amount of the first and second components.

3. A corrosion-resistant and wear-resistant titanium-base sintered alloy comprising TiC from 42 to 67 vol % and the remainder being composed of two components, the first component being at least one selected from the group consisting of Nb, Ta, Mo, W and their mutual solid solutions, and carbides, nitrides, and carbonitrides of at least one selected from the group consisting of Nb, Ta, Mo, W and their mutual solid solutions, the second component being titanium, the amount of said first component being 4 to 30 vol % in the total amount of said first component and said second components, which is obtained by sintering a press-formed compact of starting mixed powder under a sintering condition of vacuum atmosphere and temperature from 1300° C. to 1500° C., and having a hardness H of at least $50H_RC$, a bend-strength B of at least 0.3 GPa scale and a total of 0.03×H and B of at least 2.3.

* * * * *